US006058631A

United States Patent [19]

Crawford

[11] Patent Number: 6,058,631

[45] Date of Patent: May 9, 2000

[54] TRENCH CLEANING APPARATUS

[76] Inventor: Douglas Dean Crawford, 3603 Crawford Rd., Spicewood, Tex. 78669

[21] Appl. No.: 09/119,756

[22] Filed: Jul. 21, 1998

[51] Int. Cl.[7] ..... E02F 5/00; E02F 5/30; E02D 17/06

[52] U.S. Cl. ..... 37/349; 37/347; 37/380; 37/442

[58] Field of Search ..... 37/347, 349, 366, 37/367, 370, 379, 380, 442

[56] References Cited

U.S. PATENT DOCUMENTS

| | | | |
|---|---|---|---|
| Re. 35,088 | 11/1995 | Gilbert . | |
| 819,313 | 5/1906 | Reed et al. | 37/366 |
| 1,020,468 | 3/1912 | Wermuth et al. | 37/380 |
| 1,659,768 | 2/1928 | Dietrich | 37/347 |
| 2,645,091 | 7/1953 | Palmer | 37/366 |
| 2,684,543 | 7/1954 | Cundiff, Sr. | 37/366 |
| 2,911,735 | 11/1959 | Sanner et al. | 37/366 |
| 3,217,500 | 11/1965 | Diamond et al. . | |
| 3,268,012 | 8/1966 | Ratkowski . | |
| 3,300,989 | 1/1967 | Reising . | |
| 4,142,817 | 3/1979 | Lazure . | |
| 4,233,761 | 11/1980 | Ryerson . | |
| 4,404,760 | 9/1983 | Hahn et al. . | |
| 4,481,728 | 11/1984 | Mulder et al. . | |
| 4,932,478 | 6/1990 | Jones . | |
| 4,965,945 | 10/1990 | Emrich . | |
| 5,337,495 | 8/1994 | Pippins . | |
| 5,469,648 | 11/1995 | Jones et al. . | |
| 5,515,624 | 5/1996 | Beatty . | |
| 5,522,676 | 6/1996 | Gryba . | |
| 5,526,591 | 6/1996 | Otwell . | |
| 5,561,923 | 10/1996 | Kitanaka . | |
| 5,607,206 | 3/1997 | Siddle et al. . | |
| 5,709,043 | 1/1998 | Jones et al. . | |
| 5,765,966 | 6/1998 | White et al. . | |
| 5,833,008 | 11/1998 | Reed et al. | 171/141 |

*Primary Examiner*—Eileen Dunn Lillis
*Assistant Examiner*—Gary S. Hartmann
*Attorney, Agent, or Firm*—Felsman, Bradley, Vaden, Gunter & Dillon, LLP

[57] ABSTRACT

A trench cleaning apparatus for attachment to a tractor, the trench cleaning apparatus for extricating crumbs from a trench into control of the tractor. The trench cleaning apparatus utilizes a rigid member having a top edge, a bottom edge, a first side edge and a second side edge. When the rigid member is inserted into a trench at an angle to horizontal and propelled, the first edge and the second edge engage the sidewalls of the trench and the bottom edge of the rigid member engages the bottom of the trench. As the rigid member is propelled, crumbs flow from the bottom of the trench to the top of said rigid member such that crumbs are extricated from the trench and the trench is cleaned. A bucket can be utilized in cooperation with the trench cleaning apparatus such that crumbs above ground level can also be removed.

20 Claims, 2 Drawing Sheets

TRENCH CLEANING APPARATUS

BACKGROUND OF THE INVENTION

1. Technical Field

The present invention relates in general to the excavation of earth, and in particular for extracting remnant material from a trench and remnant material which is proximate to the trench. Still more particularly, the present invention relates to an apparatus for grooming a trench after the trench has been cut.

2. Description of the Related Art

Creating trenches for underground utilities such as water, sewer, and electricity is a multi-billion dollar industry. Historically, a considerable amount of human labor has been required to dig trenches and prepare trenches for the insertion of conduit or wires. Cutting, grooming and back-filling trenches is a construction process which presently requires a significant amount of manual labor. Due to the high cost of manual labor, a competitive industry for mechanized trenching equipment has evolved. The quest to minimize manual labor in preparing trenches has created significant competition in the trenching machinery industry.

After a trench has been cut into the earth, the crumbs or remnant material typically remains at the bottom of the trench and at the mouth of the trench. Grooming the bottom of the trench to remove crumbs before placement of conduit or electrical wire nearly always requires manual labor. This process is often called "crumbing" the trench. For many applications such as septic field excavation, the bottom of the trench must be homogenous or the bottom of the trench must not have high and low areas. If a trench is narrow and deep such that an individual cannot stand in the trench, a considerable amount of manual labor is required to groom the trench.

Referring to FIG. 1, a cross-sectional illustration of a furrow or trench 10 is depicted. In the lower portion of trench 10, crumbs 18 reside which were never fully extracted from trench 10 or have fallen into trench 10. Additionally, crumbs at ground level 12 reside beside the mouth of trench 10. Sidewalls 16 of trench 10 are comprised of undisturbed soil or rock.

A typical trenching operation must comply with a written specification for the specific application. Generally, a trench specification is based upon the composition of the earth and what will be placed in the trench. For example, field tile and/or leach lines of a septic system require the bottom of the trench to be level such that when the conduit is placed into the trench it is linear. Laying the conduit over undulations or high spots and low spots can create serious malfunctions in the performance of a drainage system.

Further, certain trench specifications require the back-fill material to be of a specific nature, such as sand. When the back-fill material is to be a foreign material such as sand or concrete, substantially all surface crumbs 14 at ground level 12 above trench 10 as well as crumbs 18 in the bottom of trench 10 must be removed from the excavation area.

Attempting to remove crumbs from the top of trench 10 is very tedious because a loader bucket or blade will push surface crumbs 14 at the top of trench 10 into the bottom of trench 10. Many attempts have been made to enhance the cleaning capabilities of trenching machinery. For example, a member called a "crumber" has been placed at the end of the chain or conveyor on trenchers to pull the crumbs along and feed the crumbs back into the trenching chain for extraction from the trench.

Crumbers provide less than satisfactory results because crumbs on top of the trench typically fall back into the trench after the trenching machine has passed. Crumbers are also ineffective if the crumbs at the top of the trench are to be removed.

Conveyor belt arrangements have been utilized to convey crumbs further from the mouth of the trench. However, for implementation of a septic field parallel trenches are spaced only a few feet apart and conveyors either dump crumbs into an existing trench or leave the soil uneven on an area which is yet to be trenched. A conveyor for carrying spoils away from the trench is unsuited for many trenching applications.

It would therefore be desirable to provide an apparatus to clean crumbs proximate to a trench. It would be advantageous to provide an apparatus for simultaneously cleaning the bottom of a trench and the mouth of the trench.

SUMMARY OF THE INVENTION

It is therefore one object of the present invention to provide an apparatus for excavation of earth.

It is another object of the present invention to provide an apparatus for extracting remnant material from a trench and remnant material which is proximate to the trench.

It is yet another object of the present invention to provide an apparatus for grooming a trench after the trench has been cut.

The foregoing objects are achieved as is now described. A trench cleaning apparatus for attachment to a tractor for extricating crumbs from a trench and placing the crumbs into control of the tractor is provided. The trench cleaning apparatus utilizes a rigid member having a top edge, a bottom edge, a first side edge and a second side edge. When the rigid member is inserted into a trench at an angle to the horizontal and propelled, the first edge and the second edge engage the sidewalls of the trench and the bottom edge of the rigid member engages the bottom of the trench. As the rigid member is propelled, crumbs flow from the bottom of the trench to the top of said rigid member such that crumbs are extricated from the trench and the trench is cleaned.

The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF ILLUSTRATIVE EMBODIMENT

Figure 2:
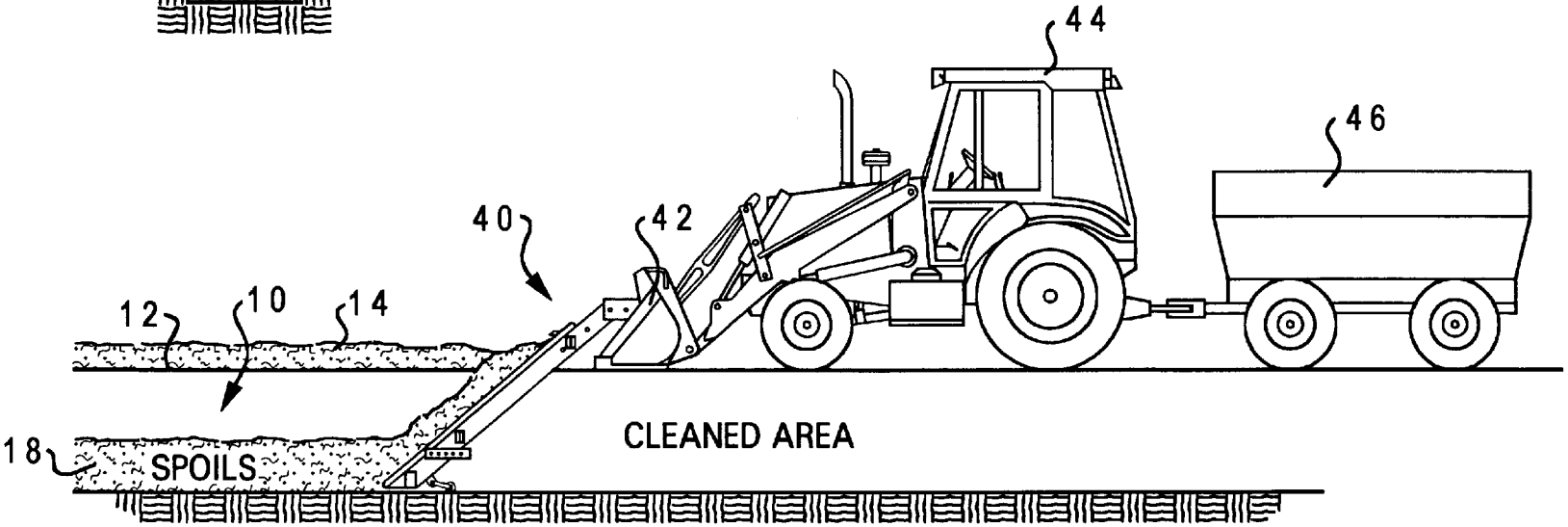
FIG. 2 is a pictorial representation depicting a trench cleaning apparatus during operation in accordance with one embodiment of the present invention.

With reference now to the figures and in particular with reference to FIG. 2, a cross-sectional side view of a trench cleaning apparatus in operation is illustrated in accordance with one embodiment of the present invention.

Figure 1:
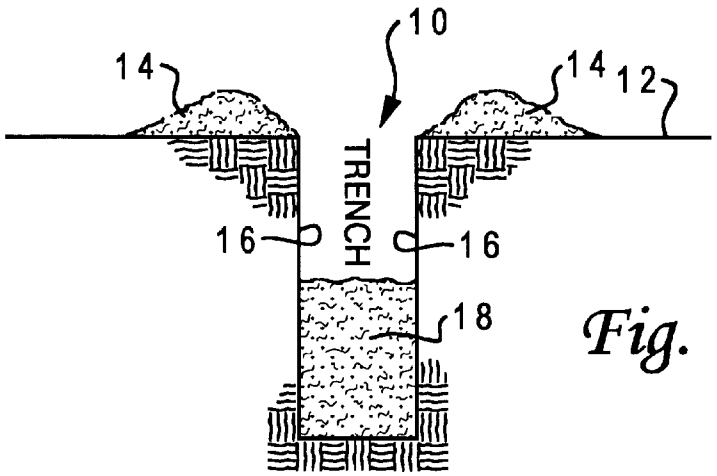
FIG. 1 is a sectional view illustrating a typical trench after a trenching operation.

FIG. 2 illustrates trench 10 of FIG. 1 rotated 90 degrees. In FIGS. 1 and 2 like elements retain like reference call-outs numerals. Trench cleaning apparatus 40 is illustrated attached to a motorized vehicle adapted for construction purposes such as tractor 44.

Specifically, trench cleaning apparatus 40 is attached to a crumb controlling member such as blade or bucket 42. A blade or bucket 42 is typically an integral part of tractor 44 adapted for construction purposes. Surface crumbs 14 at the mouth of trench 10 or above ground level 12 are also depicted in FIG. 2.

The illustrated tractor 44 could be a crawler tractor utilizing a track to engage the ground such as those built by Caterpillar® or John Deere®. Alternately, tractor 44 could be a rubber tire vehicle such as a rubber tire loader manufactured by Bobcat® or Case®. However, any manufacturer or any vehicle adapted for construction purposes which could effectively push or pull trench cleaning apparatus 40 could be utilized by the present invention.

A tractor 44 adapted for excavation purposes typically has a push blade or loader bucket attached to the front of tractor 44. However, any blade, bucket or moldboard mounted on the front or rear of a tractor could be utilized to lift, push or move soil in cooperation with trench cleaning apparatus 40 and not part from the scope of the present invention.

The embodiment illustrated depicts a single grooming operation where crumbs are removed from trench 10. Alternately described, the grooming operation depicted is commenced after a trenching device such as a chain trencher, a wheel trencher, or a rock saw has freed the crumbs from restraint of the surrounding soil. However, the present invention could be utilized concurrently with the trenching device or in the same pass as the operation which loosens the soil and initially creates the trench.

As tractor 44 moves parallel to trench 10, trench cleaning apparatus 40 forces crumbs 18 in bottom of trench 10 and out of trench 10 and above ground level 12 such that blade or bucket 42 attached to tractor 44 can control the crumbs after the crumbs are removed from the bottom of trench 10. Additionally, blade or bucket 42 controls surface crumbs 14 which reside above ground level 12.

The extracted crumbs could be accumulated into a bucket for periodic disposal or a wake could be created by a blade. A wake could be utilized to wind-row the crumbs forming a ridge of soil above ground level 12. Alternately, the extricated crumbs could be augured away utilizing a conveyor belt preferably into a storage bin 46 which is being pulled by, or is integral with tractor 44.

Figure 3:
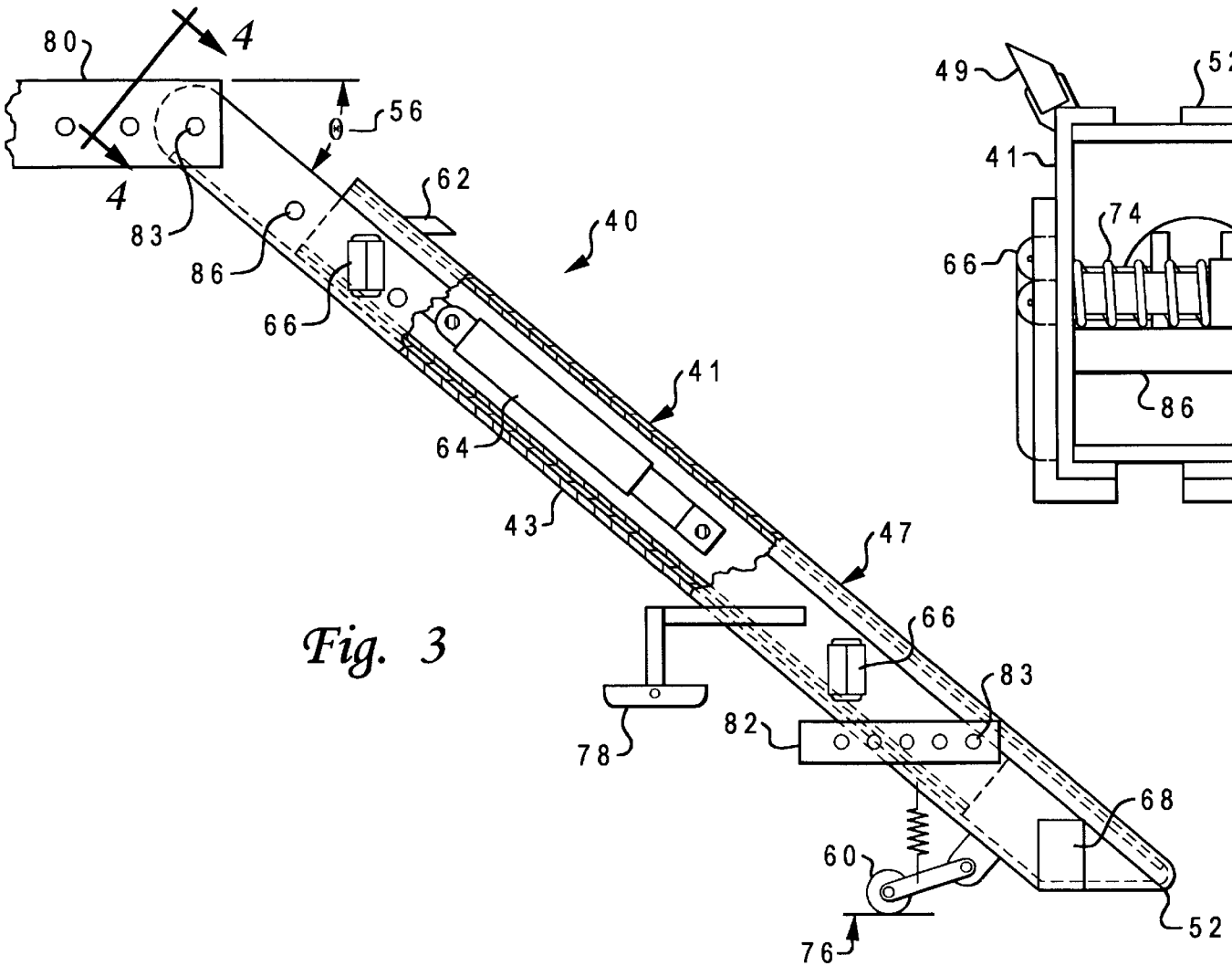
FIG. 3 is a side elevational view illustrating the trench cleaning device of FIG. 2.

Referring now to FIG. 3, a detailed view of trench cleaning apparatus 40 is depicted in accordance with the present invention. In FIGS. 2 and 3 like elements retain like reference call-outs numerals.

It is preferred that trench cleaning apparatus 40 can be adjusted for different attitude 56 or pitch to the horizontal or earth surface. Different attitudes of trench cleaning apparatus 40 to horizontal provides an optimum ramp angle for crumbs to travel along top surface 47 of trench cleaning apparatus 40 and out of trench 10. Depending on the composition of the crumbs to be extracted from the trench, placing trench cleaning apparatus 40 at different angles to the horizontal will enhance performance. It has been determined that an angle of 30 degrees ±10 degrees to the horizontal provides optimum performance for the majority of soil types.

As trench cleaning apparatus 40 is propelled along a trench, crumbs travel on top surface 47 of trench cleaning apparatus 40. Crumbs are pushed onto top surface 47 of trench cleaning apparatus 40 by mounting crumbs in the bottom of trench 10 as trench cleaning apparatus 40 moves through trench 10 and creates a pile of crumbs in front of bottom cutting edge 52.

The embodiment illustrated utilizes removable pins 83 inserted into top mounting bracket 80 and bottom mounting bracket 82 to adjust for the pitch of trench cleaning apparatus 40. However, pitch control could be accomplished utilizing an automated means such as a hydraulic cylinder. Any mounting means including an adjustable mounting means could be utilized without parting from the scope of the present invention.

In a preferred embodiment, trench cleaning apparatus 40 is comprised of rigid member 41 which is retained in u-shaped member 43. Either rigid member 41 or u-shaped member 43 must be substantially rigid such that the forces which trench cleaning apparatus 40 encounters when moving down a trench will not bend or fatigue trench cleaning apparatus 40. Specifically, the portion of any member which protrudes below blade or bucket 42 must be substantially rigid.

The strength, dimensions and material utilized in rigid member 41 and u-shaped member 43 is determined by the size of the trench to be cleaned and the horsepower of a tractor which will propel trench cleaning apparatus 40 through the trench. Rigid member 41 is affixed into u-shaped member 43 such that rigid member 41 can be adjusted to protrude a desired depth into the trench. It is preferred to attach u-shaped member 43 to blade or bucket 42. This allows rigid member 41 to be adjusted in relationship to blade or bucket 42. Removable link 86 allows rigid member 41 to be adjusted in relation to u-shaped member 43. In a preferred embodiment, both the depth of trench insertion and offset from the center of blade or bucket 42 can be adjustable.

For trenches requiring compaction in the bottom of the trench, compaction roller 60 can be placed on the bottom of trench cleaning apparatus 40. Compaction roller 60 can be shaped to conform the bottom of a trench to any specification. Alternately, an adjustable pad 76 can be attached to trench cleaning apparatus 40 to control the depth of cleaning.

In a preferred embodiment, top surface 47 of rigid member 41 is a smooth surface. Top surface 47 of rigid member 41 can be coated with a material such as teflon or aluminum to provide minimum friction for crumbs which are transported from the bottom of rigid member 41 to the top of rigid member 41 as rigid member 41 is propelled through trench 10.

Additionally, top surface 47 of rigid member 41 could be concave shaped to enhance the transfer of crumbs from the bottom of trench 10 to ground level 12. Ground level depth pad 78 can be utilized to allow the bottom of trench variations to follow the variations in ground level of FIG. 2 when blade or bucket 42 is allowed to float at ground level.

Many precision leveling systems could be utilized in conjunction with the present invention such as a laser level system. A laser level system could provide automated feedback to control the cleaning depth of trench cleaning apparatus 40. Laser level systems are well known by those having skill in the art. A laser system utilizing a sensor 62 and first hydraulic actuator 64 and a valve (not shown) could automatically control the length of trench cleaning apparatus and the corresponding depth or width of the resulting trench to provide a trench having precision dimensions.

Wall sensing skid 68 is utilized to determine if trench cleaning apparatus is within a trench. Trench cleaning apparatus remains narrow until it is inserted into the trench and expands until the cutting edges engage the sidewalls of any width of trench with a predetermined amount of pressure.

Width sensing rollers 66 are utilized to widen or narrow trench cleaning apparatus 40 to the width which will perform best in cleaning trench 10.

Figure 4:
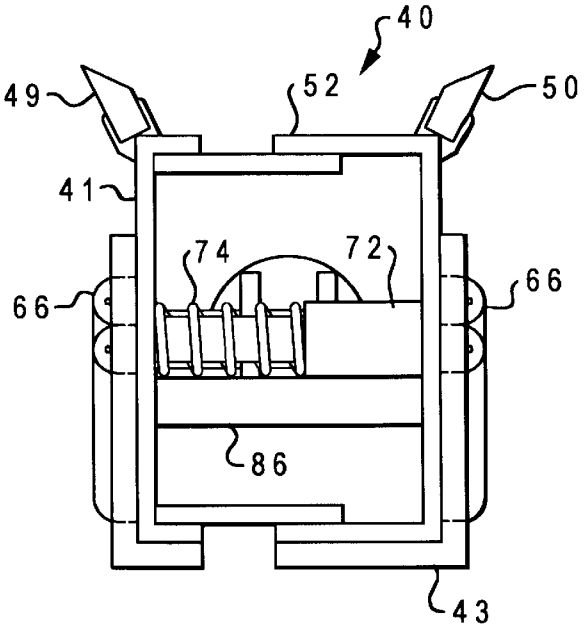
FIG. 4 is a cross sectional view illustrating the trench cleaning device of FIGS. 2 and 3.

Referring to FIG. 4, a cross-sectional view of rigid member 41 and u-shaped member 43 is illustrated. Trench cleaning apparatus 40 provides a left side cutting edge 49 and a right side cutting edge 50. Left side cutting edge 49 and right side cutting edge 50 each engage a side wall of a trench and prevent crumbs from passing between trench cleaning apparatus 40 and the trench sidewalls, when trench cleaning apparatus 40 is propelled through a trench.

Left side cutting edge 49 and right side cutting edge 50 engage sidewalls 16 of trench 10 in FIG. 1 as rigid member 41 is propelled through trench 10. Rigid member 41 can be a solid bar or it could be manufactured from a hollow material such as square tubing.

Cutting edges of rigid member 41 creates only minimal friction as trench cleaning device is propelled through a trench. Providing side edges which minimize the engagement of rigid member 41 with the trench sidewalls prevents binding as trench cleaning device is propelled through trench 10.

Bottom cutting edge 52 grooms the bottom of trench 10 and prevents crumbs from passing under trench cleaning apparatus 40 as trench cleaning apparatus 40 is mobilized through trench 10.

In trenches which require large round conduit or tile to be placed in the bottom of the trench it can be beneficial to groom the bottom of the trench such that the bottom of the trench has a semi-circular nature. Hence, in an alternate embodiment bottom cutting edge 52 is a semi-circular shape to provide additional grooming for the bottom of the trench.

A spring 74 can be utilized to expand left side cutting edge 49 and right side cutting edge 50 of trench cleaning apparatus to engage the sidewalls of trench 10 at a predetermined force. Additionally, the cutting edges could be expanded utilizing a hydraulic feedback system where the cutting edges are expanded by second hydraulic actuator 72.

It is preferred that bottom cutting edge 52, left side cutting edge 49 and right side cutting edge 50 are removable such that the cutting edges can be removed for sharpening and replacement when they become worn.

In a preferred embodiment, bottom cutting edge 52, left side cutting edge 49 and right side cutting edge 50 are all adjustable to provide cleaning for trenches of any width or depth. Although the embodiment illustrated provides an adjustable width and depth by inserting removable pins into a series of holes, a hydraulically adjustable model would not part from the scope of the present invention.

In an additional embodiment, trench cleaning apparatus 40 is spring loaded such that it can move laterally on blade or bucket 42 such that tractor 44 does not have to be perfectly aligned with the trench to prevent binding.

While the invention has been particularly shown and described with reference to a preferred embodiment, it will be understood by those skilled in the art that various changes in form and detail may be made therein without departing from the spirit and scope of the invention.

What is claimed is:

1. A trench cleaning apparatus for extricating crumbs from a trench, the trench cleaning apparatus comprising:

a rigid member having a top edge, a bottom edge, a first side edge and a second side edge;

means for removably attaching said rigid member to a vehicle, such that when said rigid member is inserted into a trench at an angle to horizontal and propelled, said first side edge and said second side edge engage sidewalls of said trench and said bottom edge engages a bottom of said trench and crumbs flow from said bottom of said trench towards said top edge of said rigid member and out of said trench, thereby cleaning said trench; and a depth pad coupled to said rigid member to allow said rigid member to float on a bottom of said trench and extract loose crumbs.

2. The trench cleaning apparatus of claim 1, further comprising a crumb controlling member coupled to said rigid member wherein said crumbs which are transported out of said trench are controlled by said crumb controlling member.

3. The trench cleaning apparatus of claim 2, wherein said crumb controlling member is a bucket.

4. The trench cleaning apparatus of claim 2, wherein said crumb controlling member is a blade.

5. The trench cleaning apparatus of claim 2, further comprising a mounting bracket for adjustable attaching said trench cleaning apparatus to said crumb controlling member.

6. The trench cleaning apparatus of claim 2, further comprising a mounting brackets for attaching said rigid member to said crumb controlling member wherein said crumb controlling member allows crumb removal of crumbs above said trench.

7. The trench cleaning apparatus of claim 2, wherein said rigid member is adjustable in relationship to said crumb controlling member to accommodate trench depth.

8. The trench cleaning apparatus of claim 1, wherein said first side edge, said second side edge and said bottom edge are cutting edges.

9. The trench cleaning apparatus of claim 1, wherein said rigid member is adjustable in width.

10. The trench cleaning apparatus of claim 1, wherein said rigid member is further comprised of a means for automatically adjusting said rigid member in length responsive to a leveling system.

11. The trench cleaning apparatus of claim 1, wherein said bottom edge of said rigid member is semi-circular.

12. The trench cleaning apparatus of claim 1, further comprising a depth guide coupled to said rigid member.

13. The trench cleaning apparatus of claim 1, further comprising a compaction roller attached to said rigid member.

14. The trench cleaning apparatus of claim 9, further comprising width sensors for automatically adjusting the width of said rigid member to a width of said trench.

15. The trench cleaning apparatus of claim 1, further comprising a spring-loaded mounting bracket allowing said trench cleaning apparatus to move laterally in relationship to said tractor.

16. The trench cleaning apparatus of claim 1, further comprising a trench sensor for increasing a length of said rigid member when said rigid member is inserted into said trench to a pre-excavated depth.

17. A trench cleaning apparatus for extricating crumbs from a trench, the trench cleaning apparatus comprising:

a rigid member having a top edge, a bottom edge, a first side edge and a second side edge, said rigid member being adjustable in width;

means for removably attaching said rigid member to a vehicle, such that when said rigid member is inserted into a trench at an angle to horizontal and propelled, said first side edge and said second side edge engage sidewalls of said trench and said bottom edge engages a bottom of said trench and crumbs flow from said bottom of said trench towards said top edge of said rigid member and out of said trench, thereby cleaning said trench.

18. The trench cleaning apparatus of claim 17, further comprising width sensors for automatically adjusting the width of said rigid member to a width of said trench.

19. A trench cleaning apparatus for extricating crumbs from a trench, the trench cleaning apparatus comprising:

a rigid member having a top edge, a bottom edge, a first side edge and a second side edge;

means for removably attaching said rigid member to a vehicle, such that when said rigid member is inserted into a trench at an angle to horizontal and propelled, said first side edge and said second side edge engage sidewalls of said trench and said bottom edge engages a bottom of said trench and crumbs flow from said bottom of said trench towards said top edge of said rigid member and out of said trench, thereby cleaning said trench; and means for automatically adjusting said rigid member in length responsive to a leveling system.

20. A trench cleaning apparatus for extricating crumbs from a trench, the trench cleaning apparatus comprising:

a rigid member having a top edge, a bottom edge, a first side edge and a second side edge;

means for removably attaching said rigid member to a vehicle, such that when said rigid member is inserted into a trench at an angle to horizontal and propelled, said first side edge and said second side edge engage sidewalls of said trench and said bottom edge engages a bottom of said trench and crumbs flow from said bottom of said trench towards said top edge of said rigid member and out of said trench, thereby cleaning said trench; and a depth guide coupled to said rigid member.

* * * * *